US009217969B2

(12) United States Patent
Wu et al.

(10) Patent No.: US 9,217,969 B2
(45) Date of Patent: Dec. 22, 2015

(54) FUSER MEMBER COATING COMPOSITIONS

(71) Applicant: Xerox Corporation, Norwalk, CT (US)

(72) Inventors: Jin Wu, Pittsford, NY (US); Jonathan H Herko, Walworth, NY (US); Lanhui Zhang, Webster, NY (US); Lin Ma, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 419 days.

(21) Appl. No.: 13/773,619

(22) Filed: Feb. 21, 2013

(65) Prior Publication Data

US 2014/0234545 A1 Aug. 21, 2014

(51) Int. Cl.
*B05D 3/02* (2006.01)
*G03G 15/20* (2006.01)

(52) U.S. Cl.
CPC ..... *G03G 15/2057* (2013.01); *G03G 15/206* (2013.01)

(58) Field of Classification Search
None
See application file for complete search history.

(56) References Cited

U.S. PATENT DOCUMENTS

| | | | | |
|---|---|---|---|---|
| 6,201,945 | B1 * | 3/2001 | Schlueter et al. | 399/329 |
| 2010/0247918 | A1 * | 9/2010 | Wu | 428/411.1 |
| 2012/0052306 | A1 * | 3/2012 | Wu et al. | 428/421 |

OTHER PUBLICATIONS

Anderson Materials, Solving a Polymer Sealing Problem with XPS Analysis, Anderson Materials Evaluation, Inc., Jul. 14, 2015, pp. 1-3.*

* cited by examiner

*Primary Examiner* — Callie Shosho
*Assistant Examiner* — Patrick English
(74) *Attorney, Agent, or Firm* — Eugene O. Palazzo

(57) ABSTRACT

A xerographic fuser member that contains a composition of a polyimide and a perfluoropolyether phosphate.

13 Claims, 3 Drawing Sheets

FUSER MEMBER COATING COMPOSITIONS

This disclosure is generally directed to fuser members useful in electrophotographic imaging apparatuses, including digital, image on image, and transfix solid ink jet printing systems, and where the fuser member is comprised of a mixture of a polyimide and a perfluoropolyether phosphate.

BACKGROUND

In the process of xerography, a light image of an original to be copied is typically recorded in the form of a latent electrostatic image upon a photosensitive or a photoconductor member with subsequent rendering of the latent image visible by the application of particulate thermoplastic material, commonly referred to as toner. The visual toner image can be either fixed directly upon the photosensitive member or the photoconductor member or transferred from the member to another support, such as a sheet of plain paper, with subsequent affixing by, for example, the application of heat and pressure of the image thereto.

To affix or fuse toner material onto a support member like paper, by heat and pressure, it is usually necessary to elevate the temperature of the toner and simultaneously apply pressure sufficient to cause the constituents of the toner to become tacky and coalesce. In both the xerographic as well as the electrographic recording arts, the use of thermal energy for fixing toner images onto a support member is known.

One approach to the heat and pressure fusing of toner images onto a support has been to pass the support with the toner images thereon between a pair of pressure engaged roller members, at least one of which is internally heated. For example, the support may pass between a fuser roller and a pressure roller. During operation of a fusing system of this type, the support member to which the toner images are electrostatically adhered is moved through the nip formed between the rollers with the toner image contacting the fuser roll thereby to effect heating of the toner images within the nip.

Also known are centrifugal molding processes to obtain seamless polyimide belts useful as fuser members. Typically, a thin fluorine or silicone release layer is applied to the inner surface of a rigid cylindrical mandrel, and a polyimide coating is applied to the inner surface of the mandrel containing the release layer and where the polyimide is cured and then released from the mandrel. There are a number of disadvantages relating to the aforementioned processes such as that the length of the polyimide belt is determined by the size of the mandrel and that there is a requirement of a release layer on the inner surface of the mandrel which can be costly and which involves an additional process step. Thus, without an added release layer the polyimide usually will not self release without any external efforts.

There is a need for xerographic fusing members that substantially avoid or minimize the disadvantages of a number of known fusing members.

Also, there is a need for fuser member materials that possess self-release characteristics from a number of substrates that are selected when such members are prepared.

There is also a need for fusing members that are selected for the heat fusing of developed images in xerographic processes, and where the members are free of a separate release layer.

Yet another need resides in providing a fusing member and fusing seamless belts that can be generated at a cost lower than those fuser members that contain a release layer.

Additionally, there is a need for fusing members and seamless belts thereof that contain compositions that can be economically and efficiently manufactured.

Further, there is a need for fusing members with a combination of excellent mechanical properties thereby extending the life time thereof and with stable substantially consistent characteristics as illustrated herein, and where only a single coating layer is needed.

These and other needs are achievable in embodiments with the fuser members and components thereof disclosed herein.

SUMMARY

There is disclosed a fuser member comprising a substrate layer of polyimide and a perfluoropolyether phosphate; a xerographic fuser belt comprising a composition of a polyimide and a perfluoropolyether phosphate of the following formulas/structures $$(HO)_2-\underset{\underset{O}{\|}}{P}-O(CH_2CH_2O)_s-CH_2CF_2O-(CF_2CF_2O)_p-(CF_2O)_q-CF_2CH_2-(OCH_2CH_2)_sO-\underset{\underset{O}{\|}}{P}-(OH)_2$$

where p/q is from about 0.5 to about 3, and s is 1 or 2; and a method of forming a fuser belt suitable for use with a xerographic image forming system comprising flow coating a composition comprising a polyimide, a perfluoropolyether phosphate, and a solvent onto the outer surface of a rotating substrate, and pre-curing the coating composition at a temperature of from about 125° C. to about 250° C., followed by a final curing at a temperature of from about 250° C. to about 370° C.

FIGURES

The following Figures are provided to further illustrate the fuser members disclosed herein.

EMBODIMENTS

The terms "including", "includes", "having", "has", "with", or variants thereof are intended to be inclusive in a manner similar to the term "comprising". The term "at least one of" means, for example, that one or more of the listed items can be selected.

Any disclosed numerical value, however, inherently contains certain errors necessarily resulting from the standard deviation found in their respective testing measurements. Moreover, all ranges disclosed herein are to be understood to encompass any and all sub-ranges subsumed therein. For example, a range of from about 1 to about 10 can include any and all sub-ranges there between such as 2, 3, 4, 5, 6, 7, 8, 9, and 10, and about can include ranges below 1 and ranges above 10.

The disclosed fuser member comprises a mixture of a polyimide polymer and a perfluoropolyether phosphate.

In various embodiments, the fuser member can include, for example, a substrate layer comprising a mixture of a polyimide polymer and a perfluoropolyether phosphate with one or more functional intermediate layers formed thereon. The substrate can be formed in various shapes, such as a belt, or a film using suitable materials that are non-conductive or conductive with the thickness of the member being, for example, from about 30 to about 1,000 microns, from about 100 to about 800 microns, from about 150 to about 500 microns, from about 100 to about 125 microns, or from about 75 to about 80 microns.

The arrows in each of the Figures illustrate the direction of movement of the various components shown.

Figure 1:
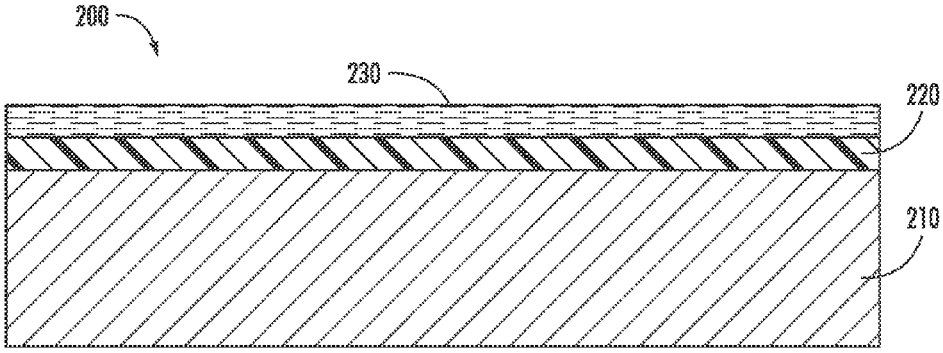
FIG. 1 illustrates an exemplary embodiment of a fuser member in the form of a belt of the present disclosure.

In FIG. 1 an exemplary embodiment of the present disclosure, a fusing or transfix member 200, can include a substrate or belt 210 comprised of a mixture of a polyimide polymer and a perfluoropolyether phosphate with one or more, such as from one to about 4, or from 1 to about 2, functional intermediate layers 220, and an optional outer surface release layer 230 formed thereon.

Figure 2A:
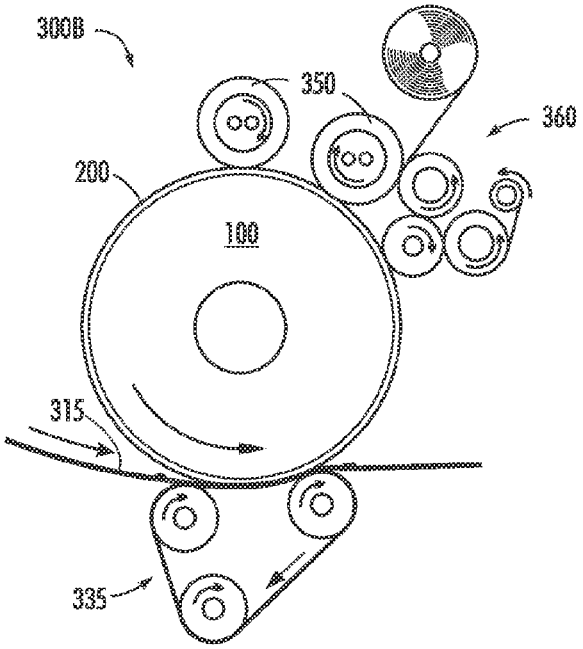
FIGS. 2A and 2B illustrate exemplary generalized fusing configurations of the present disclosure.
Figure 2B:
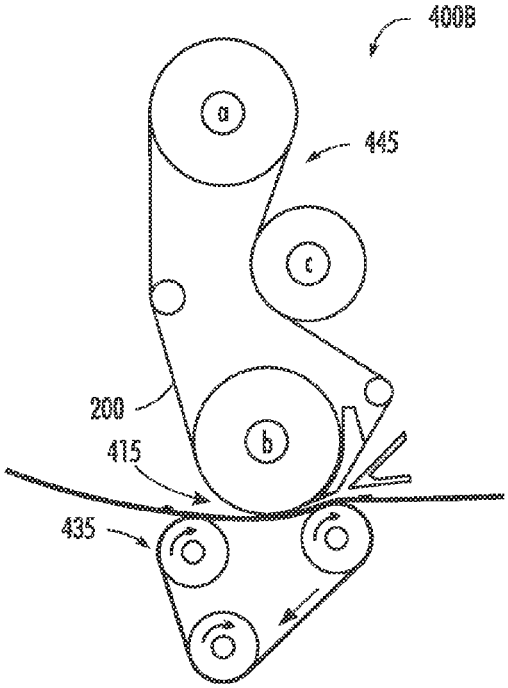

FIGS. 2A and 2B illustrate exemplary generalized fusing configurations for fusing processes in accordance with the present disclosure, noting that although an electrophotographic printer is described herein, the disclosed apparatus and method can be applied to other printing technologies, examples of which include offset printing and inkjet and solid ink jet transfix machines and for oilless fusing systems.

FIG. 2A illustrates the fusing configuration 300B, incorporating the fuser member shown in FIG. 1. The configuration 300B, can include the fuser belt of FIG. 1, circumferentially wrapped around a drum 100, that forms a fuser nip with a pressure applying mechanism 335, which includes a pressure belt for an image supporting material 315. In various embodiments, the pressure applying mechanism 335 can be used in combination with a heat lamp (not shown) to provide both the pressure and heat for the fusing or fixing of the toner particles on the image supporting material 315. In addition, the configuration 300B can include one or more external heat rolls 350, together with a cleaning web 360, as shown in FIG. 2A.

FIG. 2B illustrates the fusing configuration 400B with the fuser member shown in FIG. 1. The configuration 400B can include the fuser member in the form of a belt 200 of FIG. 1 that forms a fuser nip with a pressure applying mechanism 435, such as a pressure belt, with rollers for a media or paper substrate 415. In various embodiments, the pressure applying mechanism 435 can be used in a combination with a heat lamp (not shown) to provide both the pressure and heat for the fusing of the toner particles on the media substrate, such as paper 415. In addition, the configuration 400B can include a mechanical system 445 to move the fuser belt 200 and thus fusing the toner particles and forming images on the media substrate 415. The mechanical system 445 can include one or more rolls 445*a* to *c*, which can also be used as heat rolls when needed.

Figure 3:
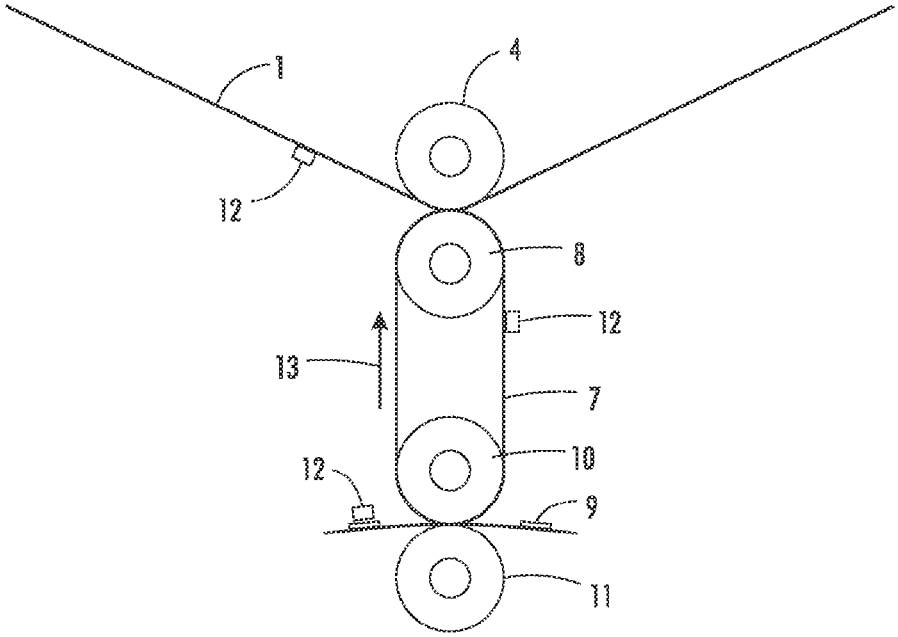
FIG. 3 illustrates an exemplary embodiment of a transfix apparatus of the present disclosure.

FIG. 3 demonstrates a view of an embodiment of a transfix member 7, which may be in the form of a belt, sheet, film, or like form. The transfix member 7 is constructed similarly to the fuser member 200 of FIG. 1, or belt 200 of FIG. 2B illustrated herein. The xerographic developed image 12, positioned on fusing member 1, is brought into contact with and transferred to transfix member 7, via rollers 4 and 8. Roller 4 and/or roller 8 may or may not have heat associated therewith. Transfix member 7 proceeds in the direction of arrow 13. The developed image 12 is transferred by transfix member 7, and fused to a copy substrate 9, as the copy substrate 9 is advanced between rollers 10 and 11 to result in the final fused toner developed image 12. Rollers 10 and/or 11 may or may not have heat associated therewith.

Figure 4:
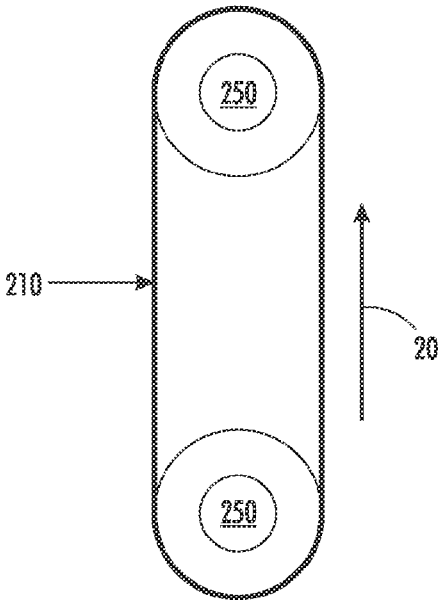
FIG. 4 illustrates an exemplary embodiment of a tensioning device to accomplish the final curing of the fuser member coating composition.

FIG. 4 illustrates a curing device for the fuser member of the present disclosure. The curing of the disclosed fuser member coatings is accomplished at a tension of from about 1 kilogram to about 10 kilograms or from about 3 to about 7 kilograms, and where the pre-cured member or belt 210 is tensioned between two rollers 250, while rotating in the direction of arrow 20.

The disclosed fuser member composition mixture of the polyimide and the perfluoropolyether phosphate can be flow coated on a welded stainless steel belt or an electroformed seamless nickel belt at the desired product circumferences. The polyimide perfluoropolyether phosphate belt is partially cured, or pre-cured at, for example, from about 150° C. to about 250° C., from about 125° C. to about 250° C., or from about 180° C. to about 220° C. for a time of, for example, from about 30 minutes to about 90 minutes, or from about 45 minutes to about 75 minutes, and self releases from the stainless steel belt or electroformed seamless nickel belt, and then is further completely cured at, for example, from about 250° C. to about 370° C., or from about 300° C. to about 340° C., for a time period of, for example, from about 30 minutes to about 150 minutes, or from about 60 minutes to about 120 minutes under tension in the configuration shown in FIG. 4. For the final curing the belt is at a tension of from about 1 kilogram to about 10 kilograms or from about 3 to about 7 kilograms, and where the pre-cured belt 210 is tensioned between two rollers 250, while rotating in the direction of arrow 20.

There is also disclosed herein a method of forming a fuser belt suitable for use with an image, such as a xerographic image, forming system. The method comprises, for example, the flow coating of a composition comprising a polyimide, a perfluoropolyether phosphate, and a solvent onto the outer surface of a rotating substrate, such as welded stainless steel belt or an electroformed seamless nickel belt at the desired product circumferences. The coating is partially cured and then subsequently cured as illustrated herein.

Fuser Member Compositions

The disclosed fuser member can be comprised of a mixture of a polyimide and a perfluoropolyether phosphate, which composition self releases from a metal substrate, such as stainless steel, and where an external release layer on the metal substrate can be avoided. Thus, the disclosed composition is cost effective since, for example, only one coating layer is needed.

In an embodiment, the disclosed fuser substrate layer composition comprises a polyimide precursor, such as a polyamic acid, and in particular a polyamic acid of biphenyl tetracarboxylic dianhydride/4,4'-oxydianiline, and primarily functioning as an internal release agent, a perfluoropolyether phosphate.

Polyimides

Examples of polyimides selected for the fuser members illustrated herein can be formed from a polyimide precursor of a polyamic acid that includes one of a polyamic acid of pyromellitic dianhydride/4,4'-oxydianiline, a polyamic acid of pyromellitic dianhydride/phenylenediamine, a polyamic acid of biphenyl tetracarboxylic dianhydride/4,4'-oxydianiline, a polyamic acid of biphenyl tetracarboxylic dianhydride/phenylenediamine, a polyamic acid of benzophenone tetracarboxylic dianhydride/4,4'-oxydianiline, a polyamic acid of benzophenone tetracarboxylic dianhydride/4,4'-oxydianiline/phenylenediamine, and the like, and mixtures thereof. After curing, the resulting polyimides include a polyimide of pyromellitic dianhydride/4,4'-oxydianiline, a polyimide of pyromellitic dianhydride/phenylenediamine, a polyimide of biphenyl tetracarboxylic dianhydride/4,4'-oxydianiline, a polyimide of biphenyl tetracarboxylic dianhydride/phenylenediamine, a polyimide of benzophenone tetracarboxylic dianhydride/4,4'-oxydianiline, a polyimide of benzophenone tetracarboxylic dianhydride/4,4'-oxydianiline/phenylenediamine, and mixtures thereof.

Commercial examples of polyamic acid of pyromellitic dianhydride/4,4'-oxydianiline selected include PYRE-ML RC5019 (about 15 to 16 weight percent in N-ethyl-2-pyrrolidone, NMP), RC5057 (about 14.5 to 15.5 weight percent in NMP/aromatic hydrocarbon=80/20), and RC5083 (about 18 to 19 weight percent in NMP/DMAc=15/85), all from Industrial Summit technology Corp., Parlin, N.J.; DURIMIDE® 100, commercially available from FUJIFILM Electronic Materials U.S.A., Inc.

Examples of selected polyamic acids of biphenyl tetracarboxylic dianhydride/4,4'-oxydianiline include U-VARNISH A, and S (about 20 weight in NMP), both available from UBE America Inc., New York, N.Y.

Polyamic acids of biphenyl tetracarboxylic anhydride/phenylenediamine examples include PI-2610 (about 10.5 weight in NMP), and PI-2611 (about 13.5 weight in NMP), both available from HD MicroSystems, Parlin, N.J.

Examples of polyamic acids of benzophenone tetracarboxylic dianhydride/4,4'-oxydianiline include RP46 and RP50 (about 18 weight percent in NMP), both available from Unitech Corp., Hampton, Va.

Polyamic acids of benzophenone tetracarboxylic dianhydride/4,4'-oxydianiline/phenylenediamine examples are PI-2525 (about 25 weight percent in NMP), PI-2574 (about 25 weight percent in NMP), PI-2555 (about 19 weight percent in NMP/aromatic hydrocarbon=80/20), and PI-2556 (about 15 weight percent in NMP/aromatic hydrocarbon/propylene glycol methyl ether=70/15/15), all available from HD MicroSystems, Parlin, N.J.

More specifically, polyamic acid or esters of polyamic acid examples that can be selected for the formation of a polyimide are prepared by the reaction of a dianhydride and a diamine. Suitable dianhydrides selected include aromatic dianhydrides and aromatic tetracarboxylic acid dianhydrides such as, for example, 9,9-bis(trifluoromethyl)xanthene-2,3,6,7-tetracarboxylic acid dianhydride, 2,2-bis(3,4-dicarboxyphenyl)hexafluoropropane dianhydride, 2,2-bis((3,4-dicarboxyphenoxy)phenyl)hexafluoropropane dianhydride, 4,4'-bis(3,4-dicarboxy-2,5,6-trifluorophenoxy)octafluorobiphenyl dianhydride, 3,3',4,4'-tetracarboxybiphenyl dianhydride, 3,3',4,4'-tetracarboxybenzophenone dianhydride, di-(4-(3,4-dicarboxyphenoxy)phenyl)ether dianhydride, di-(4-(3,4-dicarboxyphenoxy)phenyl)sulfide dianhydride, di-(3,4-dicarboxyphenyl)methane dianhydride, di-(3,4-dicarboxyphenyl) ether dianhydride, 1,2,4,5-tetracarboxybenzene dianhydride, 1,2,4-tricarboxybenzene dianhydride, butanetetracarboxylic dianhydride, cyclopentanetetracarboxylic dianhydride, pyromellitic dianhydride, 1,2,3,4-benzenetetracarboxylic dianhydride, 2,3,6,7-naphthalenetetracarboxylic dianhydride, 1,4,5,8-naphthalenetetracarboxylic dianhydride, 1,2,5,6-naphthalenetetracarboxylic dianhydride, 3,4,9,10-perylenetetracarboxylic dianhydride, 2,3,6,7-anthracene tetracarboxylic dianhydride, 1,2,7,8-phenanthrenetetracarboxylic dianhydride, 3,3',4,4'-biphenyltetracarboxylic dianhydride, 2,2',3,3'-biphenyltetracarboxylic dianhydride, 3,3',4-4'-benzophenonetetracarboxylic dianhydride, 2,2',3,3'-benzophenonetetracarboxylic dianhydride, 2,2-bis(3,4-dicarboxyphenyl)propane dianhydride, 2,2-bis(2,3-dicarboxyphenyl)propane dianhydride, bis(3,4-dicarboxyphenyl)ether dianhydride, bis(2,3-dicarboxyphenyl)ether dianhydride, bis(3,4-dicarboxyphenyl)sulfone dianhydride, bis(2,3-dicarboxyphenyl)sulfone 2,2-bis(3,4-dicarboxyphenyl)-1,1,1,3,3,3-hexafluoropropane dianhydride, 2,2-bis(3,4-dicarboxyphenyl)-1,1,1,3,3,3-hexachloropropane dianhydride, 1,1-bis(2,3-dicarboxyphenyl)ethane dianhydride, 1,1-bis(3,4-dicarboxyphenyl)ethane dianhydride, bis(2,3-dicarboxyphenyl)methane dianhydride, bis(3,4-dicarboxyphenyl)methane dianhydride, 4,4'-(p-phenylenedioxy)diphthalic dianhydride, 4,4'-(m-phenylenedioxy)diphthalic dianhydride, 4,4'-diphenylsulfidedioxybis(4-phthalic acid) dianhydride, 4,4'-diphenylsulfonedioxybis(4-phthalic acid) dianhydride, methylenebis(4-phenyleneoxy-4-phthalic acid) dianhydride, ethylidenebis(4-phenyleneoxy-4-phthalic acid) dianhydride, isopropylidenebis(4-phenyleneoxy-4-phthalic acid)dianhydride, hexafluoroisopropylidenebis(4-phenyleneoxy-4-phthalic acid)dianhydride, and the like.

Exemplary diamines selected suitable for use in the preparation of the polyamic acid include 4,4'-bis-(m-aminophenoxy)-biphenyl, 4,4'-bis-(m-aminophenoxy)-diphenyl sulfide, 4,4'-bis-(m-aminophenoxy)-diphenyl sulfone, 4,4'-bis-(p-aminophenoxy)-benzophenone, 4,4'-bis-(p-aminophenoxy)-diphenyl sulfide, 4,4'-bis-(p-aminophenoxy)-diphenyl sulfone, 4,4'-diamino-azobenzene, 4,4'-diaminobiphenyl, 4,4'-diaminodiphenylsulfone, 4,4'-diamino-p-terphenyl, 1,3-bis-(gamma-aminopropyl)-tetramethyl-disiloxane, 1,6-diaminohexane, 4,4'-diaminodiphenylmethane, 3,3'-diaminodiphenylmethane, 1,3-diaminobenzene, 4,4'-diaminodiphenyl ether, 2,4'-diaminodiphenylether, 3,3'-diaminodiphenylether, 3,4'-diaminodiphenylether, 1,4-diaminobenzene, 4,4'-diamino-2,2',3,3',5,5',6,6'-octafluorobiphenyl, 4,4'-diamino-2,2',3,3',5,5',6,6'-octafluorodiphenyl ether, bis[4-(3-aminophenoxy)-phenyl]sulfide, bis[4-(3-aminophenoxy)phenyl]sulfone, bis[4-(3-aminophenoxy)phenyl]ketone, 4,4'-bis(3-aminophenoxy)biphenyl, 2,2-bis[4-(3-aminophenoxy)phenyl]-propane, 2,2-bis[4-(3-aminophenoxy)phenyl]-1,1,1,3,3,3-hexafluoropropane, 4,4'-diaminodiphenyl sulfide, 4,4'-diaminodiphenyl ether, 4,4'-diaminodiphenyl sulfone, 4,4'-diaminodiphenylmethane, 1,1-di(p-aminophenyl)ethane, 2,2-di(p-aminophenyl)propane, and 2,2-di(p-aminophenyl)-1,1,1,3,3,3-hexafluoropropane, and the like, and mixtures thereof.

The dianhydrides and diamines are, for example, selected in a weight ratio of from about 20:80 to about 80:20, and more specifically, in an about 50:50 weight ratio. The above aromatic dianhydride like aromatic tetracarboxylic acid dianhydrides, and diamines like aromatic diamines are used singly or as a mixture, respectively.

Yet more specifically, examples of polyamic acids utilized in effective amounts, such as from about 90 to about 99.99 weight percent, from about 95 to about 99 weight percent, or from about 98 to about 99.95 weight percent of the solids, include a polyamic acid of pyromellitic dianhydride/4,4'-oxydianiline, commercially available from Industrial Summit technology Corp., Parlin, N.J. with the trade name of Pyre-M.L. RC5019 or RC5083, and a polyamic acid of biphenyl tetracarboxylic dianhydride/4,4'-oxydianiline, commercially available as U-VARNISH A and S (about 20 weight in NMP), both available from UBE America Inc., New York, N.Y., or available from Kaneka Corp., Tex.

Polyimide examples selected for the disclosed fuser member substrate layer compositions are represented by at least one of the following formulas/structures, and mixtures thereof

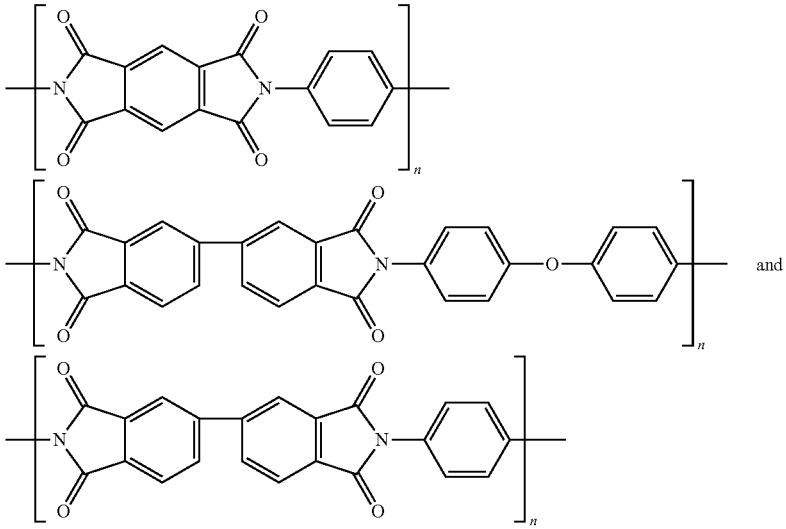

where n represents the number of repeating segments of, for example, from about 5 to about 3,000, from about 50 to about 2,000, from about 50 to about 1,500, from about 200 to about 1,200, from about 1,000 to about 2,000, or from about 1,200 to about 1,800.

Perfluoropolyether Phosphates

Perfluoropolyether phosphate examples selected for the disclosed fuser member are polyperfluoroethoxymethoxy difluoroethyl poly(ethylene glycol) phosphate, perfluoropolyether acid phosphate, perfluoropolyether poly(ethylene glycol) phosphate, diphosphoric acid, polymers with ethoxylated reduced ethyl esters of reduced polymerized oxidized tetrafluoroethylene, and where in embodiments the perfluoropolyether phosphates can be represented by the following formulas/structures

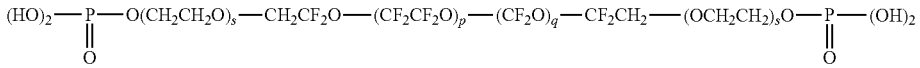

wherein s represents the number of groups and is, for example, 1 or 2, and where p/q represents the ratio of the respective groups, and which ratio can vary depending, for example, on the amounts selected, examples of the p/q ratio being from about 0.5 to about 3, from about 0.7 to about 1, from about 0.8 to about 2.5, or from about 0.5 to about 0.8.

Further specific examples of perfluoropolyether phosphates selected for the disclosed fuser member mixture include FLUOROLINK® F10 (average molecular weight=2,400 to 3,100), and FOMBLIN® HC/P2-1000 (average molecular weight=2,500), both available from Solvay Solexis.

The perfluoropolyether phosphates, which can function as a release agent or additive, are compatible with the solution coating of the polyimide and perfluoropolyether phosphate (clear in color when mixed), and the resulting polyimide is also clear with no apparent phase separation resulting. Additionally, the resulting polyimide/perfluoropolyether phosphate composition, after final curing, self-releases from a metal coating substrate like stainless steel and a thick smooth polyimide/perfluoropolyether phosphate composition fuser member was obtained.

Various amounts of a perfluoropolyether phosphate can be selected for the fuser member composition, such as for example, from about 0.01 weight percent to about 0.2 weight percent (of the solids throughout), from about 0.01 to about 1 weight percent, from about 0.01 to about 0.5 weight percent, from about 0.03 to about 0.05 weight percent, from about 0.03 to about 0.1 weight percent, from about 0.01 to about 0.5 weight percent, from about 0.01 to about 0.05 weight percent, or about 0.05 weight percent or less than or equal to about 0.05 weight percent. In embodiments, the fuser member composition of the polyimide polymer and the perfluoropolyether phosphate are present in a weight ratio of from about 99.99/0.01 to about 99.5/0.5.

One specific disclosed fuser member comprises a mixture of a polyimide of biphenyl tetracarboxylic dianhydride/4,4'-oxydianiline and the disclosed perfluoropolyether phosphate, prepared in a solvent illustrated herein, about 16 to about 20 percent by weight of solids, and where the disclosed polyimide perfluoropolyether phosphate weight ratio is, for example, 99.95/0.05.

The disclosed polyimide/perfluoropolyether phosphate composition possesses, for example, a Young's modulus of from about 4,000 MPa to about 10,000 MPa, from about 5,000 MPa to about 10,000 MPa, from about 6,500 MPA to about 7,500 MPA, from about 6,000 MPA to about 10,000 MPA, and more specifically, about 6,800 MPa; and an onset decomposition temperature of from about 400° C. to about 650° C., from about 500° C. to about 640° C., from about 600° C. to about 630° C., or about 622° C.

Functional Intermediate Layers

Examples of materials selected for the functional intermediate layers, or layer (also referred to as cushioning layer or intermediate layer), and that can provide elasticity to the fuser member and the materials in the layer or layers, and which materials can be mixed with inorganic particles, such as for example, SiC or $Al_2O_3$, include fluorosilicones, silicone rubbers, such as room temperature vulcanization (RTV) silicone rubbers, high temperature vulcanization (HTV) silicone rubbers, and low temperature vulcanization (LTV) silicone rubbers. These rubbers are known and readily available commercially, such as SILASTIC® 735 black RTV and SILASTIC® 732 RTV, both obtainable from Dow Corning; 106 RTV Silicone Rubber and 90 RTV Silicone Rubber, both obtainable from General Electric; JCR6115CLEAR HTV and SE4705U HTV silicone rubbers obtainable from Dow Corning; Toray Silicones; commercially available LSR rubbers obtainable from Dow Corning as Q3-6395, Q3-6396; SILASTIC® 590 LSR, SILASTIC® 591 LSR, SILASTIC® 595 LSR, SILASTIC® 596 LSR, and SILASTIC® 598 LSR; and siloxanes, such as polydimethylsiloxanes; fluorosilicones like Silicone Rubber 552, available from Sampson Coatings, Richmond, Va.; and liquid silicone rubbers such as vinyl crosslinked heat curable rubbers or silanol room temperature crosslinked materials.

Further materials suitable for use in the functional intermediate layer or layers also include fluoroelastomers. Fluoroelastomers are from the class of 1) copolymers of two of vinylidenefluoride, hexafluoropropylene, and tetrafluoroethylene; 2) terpolymers of vinylidenefluoride, hexafluoropropylene, and tetrafluoroethylene; and 3) tetrapolymers of vinylidenefluoride, hexafluoropropylene, tetrafluoroethylene, and a cure site monomer. These fluoroelastomers are known and commercially available under various designations such as VITON A®, VITON B®, VITON E®, VITON E 60C®, VITON E430®, VITON 910®, VITON GH®; VITON GF®; and VITON ETP®. The VITON® designation is a trademark of E.I. DuPont de Nemours, Inc. The cure site monomer can be 4-bromoperfluorobutene-1,1,1-dihydro-4-bromoperfluorobutene-1,3-bromoperfluoropropene-1,1,1-dihydro-3-bromoperfluoropropene-1, or any other suitable, known cure site monomer, such as those commercially available from DuPont. Other commercially available fluoropolymers that can be selected include FLUOREL 2170®, FLUOREL 2174®, FLUOREL 2176®, FLUOREL 2177® and FLUOREL LVS 76®, FLUOREL® being a registered trademark of 3M Company. Additional commercially available selected fluoro materials include AFLAS™ a poly(propylene-tetrafluoroethylene), and FLUOREL II® (LII900) a poly(propylene-tetrafluoroethylenevinylidenefluoride), both available from 3M Company, as well as the Tecnoflons identified as FOR-60KIR®, FOR-LHF®, NM® FOR-THF®, FOR-TFS®, TH®, NH®, P757®, TNS®, T439®, PL958®, BR9151® and TN505®, available from Ausimont Inc.

The fluoroelastomers VITON GH® and VITON GF® have relatively low amounts of vinylidenefluoride. For example, the VITON GF® and VITON GH® have about 35 weight percent of vinylidenefluoride, about 34 weight percent of hexafluoropropylene, and about 29 weight percent of tetrafluoroethylene, with about 2 weight percent cure site monomer.

The thickness of a functional intermediate layer is, for example, from about 30 to about 1,000 microns, from about 10 to about 800 microns, or from about 150 to about 500 microns.

Optional Polymers

The disclosed polyimide/perfluoropolyether phosphate fuser member composition can optionally contain a polysiloxane polymer to enhance or smooth the composition when it is applied as a coating. The concentration of the polysiloxane copolymer is equal to or less than about 1 weight percent or equal to or less than about 0.2 weight percent, and more specifically, from about 0.1 to about 1 weight percent. The optional polysiloxane polymers include, for example, a polyester modified polydimethylsiloxane, commercially available from BYK Chemical with the trade name of BYK® 310 (about 25 weight percent in xylene) and BYK® 370 (about 25 weight percent in xylene/alkylbenzenes/cyclohexanone/monophenylglycol=75/11/7/7); a polyether modified polydimethylsiloxane, commercially available from BYK Chemical with the trade name of BYK® 330 (about 51 weight percent in methoxypropylacetate) and BYK® 344 (about 52.3 weight percent in xylene/isobutanol=80/20), BYK®-SILCLEAN 3710 and 3720 (about 25 weight percent in methoxypropanol); a polyacrylate modified polydimethylsiloxane, commercially available from BYK Chemical with the trade name of BYK®-SILCLEAN 3700 (about 25 weight percent in methoxypropylacetate); or a polyester polyether modified polydimethylsiloxane, commercially available from BYK Chemical with the trade name of BYK® 375 (about 25 weight percent in Di-propylene glycol monomethyl ether). The polyimide/perfluoropolyether phosphate/polysiloxane polymer is present in, for example, a weight ratio of about 99.9/0.09/0.01 to about 95/4/1.

Optional Release Layer

Examples of the selected fuser member optional release layer include fluoropolymer particles, such as fluorine-containing polymers comprising a monomeric repeat unit that is selected from the group consisting of vinylidene fluoride, hexafluoropropylene, tetrafluoroethylene, perfluoroalkylvinylether, and mixtures thereof. The fluoropolymers may include linear or branched polymers, and crosslinked fluoroelastomers. Examples of fluoropolymer include polytetrafluoroethylene (PTFE); perfluoroalkoxy polymer resin (PFA); copolymer of tetrafluoroethylene (TFE) and hexafluoropropylene (HFP); copolymers of hexafluoropropylene (HFP) and vinylidene fluoride (VDF or VF2); terpolymers of tetrafluoroethylene (TFE), vinylidene fluoride (VDF) and hexafluoropropylene (HFP); and tetrapolymers of tetrafluoroethylene (TFE), vinylidene fluoride (VF2), and hexafluoropropylene (HFP), and mixtures thereof. The fluoropolymer particles provide chemical and thermal stability and have a low surface energy. The fluoropolymer particles have a melting temperature of from about 255° C. to about 360° C. or from about 280° C. to about 330° C. These particles are melted to form the release layer.

The thickness of the outer surface layer or release layer can be, for example, from about 10 to about 100 microns, from about 20 to about 80 microns, or from about 40 to about 60 microns.

Fuser Member Preparation

The disclosed fuser member can be prepared as illustrated herein, such as by the flow coating of the composition on a supporting substrate. Thus, the polyimide/perfluoropolyether phosphate composition, and optional components that may be present, can be flow coated on a seamless or welded stainless steel cylinder, a glass cylinder or an electroformed seamless nickel cylinder at the desired product circumference. The polyimide/perfluoropolyether phosphate belt is partially cured, or pre-cured and then fully cured as illustrated herein.

The disclosed fuser member composition can also be coated on a substrate by liquid spray coating, dip coating, wire wound rod coating, fluidized bed coating, powder coating, electrostatic spraying, sonic spraying, blade coating, molding, laminating, and the like.

The polyimide/perfluoropolyether phosphate substrate coating composition can include a solvent. Examples of the solvent selected to form the composition include toluene, hexane, cyclohexane, heptane, tetrahydrofuran, methyl ethyl ketone, methyl isobutyl ketone, N,N'-dimethylformamide, N,N'-dimethylacetamide, N-methylpyrrolidone (NMP), methylene chloride, and the like, and mixtures thereof where the solvent is selected, for example, in an amount of from about 70 weight percent to about 95 weight percent, and from 80 weight percent to about 90 weight percent based on the amounts of component in the coating mixture.

Additives and conductive or non-conductive fillers, in various amounts like, for example, from about 1 to about 40, from 2 to about 25, or from 3 to about 15 weight percent of the solids, may be present in the substrate layer of the disclosed fuser member coating composition including, for example, inorganic particles. Examples of selected fillers are aluminum nitride, boron nitride, aluminum oxide, graphite, graphene, copper flake, nano diamond, carbon black, carbon nanotube, metal oxides, doped metal oxide, metal flake, and mixtures thereof.

Self-release characteristics without the assistance of any external sources, such as prying devices, permits the efficient, economical formation, and full separation, from about 90 to about 100 percent, or from about 95 to about 99 percent of the disclosed fuser coating compositions from metal substrates, and where release materials and separate release layers can be avoided. The time period to obtain the self-release characteristics of the disclosed composition varies depending, for example, on the components present, and the amounts thereof selected. Generally, however, the release time period is from about 1 to about 65 seconds, from about 1 to about 50 seconds, from about 1 to about 35 seconds, from about 1 to about 20 seconds, or from about 1 to about 5 seconds, and in some instances less than 1 second.

Specific embodiments will now be described in detail. These examples are intended to be illustrative, and not limited to the materials, conditions, or process parameters set forth in these embodiments. All parts are percentages by solid weight unless otherwise indicated.

EXAMPLES

A composition comprising the polyamic acid of biphenyl tetracarboxylic dianhydride/4,4'-oxydianiline and the perfluoropolyether phosphate FLUOROLINK® F10 as obtained from Solvay Solexis, in a weight ratio of 99.95 to 0.05, was prepared in N-methylpyrrolidone (NMP), at about 16 solids weight percent. The polyamic acid obtained from Kaneka Corporation converts after curing by heating into the polyimide of biphenyl tetracarboxylic dianhydride/4,4'-oxydianiline. The resulting composition liquid was coated on a stainless steel substrate, and subsequently pre-cured as illustrated herein, and then cured again at 75° C. for 30 minutes, 190° C. for 30 minutes, and 320° C. for 60 minutes. The obtained polyimide/FLUOROLINK® F10 fuser belt self released from the stainless steel substrate in about 5 seconds, and an 80 micron thick smooth polyimide/FLUOROLINK® F10 substrate was obtained, and which fuser member was incorporated into a xerographic machine for the fusing of xerographic developed images as disclosed herein.

The polyimide/FLUOROLINK® F10 fuser belt substrate was further tested for modulus and coefficient of thermal expansion (CTE). The Young's modulus was about 6,800 MPa, and the CTE was 14.2 ppm/° K. As a comparison, a commercially available polyimide belt with no internal release agent had a modulus of 6,000 MPa, and a CTE of 15 ppm/° K.

The onset decomposition temperature of the disclosed polyimide/FLUOROLINK® F10 coating was about 622° C. As a comparison, the onset decomposition temperature of a commercially available polyimide belt with no internal release agent was about 510° C.

Thus, the above disclosed properties of the disclosed polyimide/FLUOROLINK® F10 fuser belt substrate were comparable to those of commercially available polyimide substrates, as disclosed herein, however, with lower manufacturing cost because, for example, of the elimination of the extra release layer coating.

The Young's Modulus was measured by following the known ASTM D882-97 process. A sample (0.5 inch×12 inch) of the fuser belt prepared above was placed in the Instron Tensile Tester measurement apparatus, and then the sample was elongated at a constant pull rate until breaking. During this time, there was recorded the resulting load versus the sample elongation. The Young's Modulus was calculated by taking any point tangential to the initial linear portion of the recorded curve results and dividing the tensile stress by the corresponding strain. The tensile stress was calculated by the load divided by the average cross-sectional area of each of the tests.

The thermal expansion coefficients (CTE) were measured by using a Thermo-mechanical Analyzer (TMA). Fuser belt samples were cut using a razor blade and metal die to 4 millimeter wide pieces which were then mounted between the TMA clamp using a measured 8 millimeter spacing. The samples were preloaded to a force of 0.05 Newtons (N). Data was analyzed from the $2^{nd}$ heat cycle. The CTE value was obtained as a linear fit through the data between the temperature points of interest of about −20° C. to about 50° C. regions using the TMA software.

The hexadecane contact angle, which translates into the degree of oleophobic characteristics, was at ambient temperature (about 23° C.) measured by using the Contact Angle System OCA (Dataphysics Instruments GmbH, model OCA15). At least ten measurements were performed, and their averages are reported.

The water contact angles illustrated herein were measured at ambient temperature (about 23° C. to 25° C.) using the known Contact Angle System OCA (Dataphysics Instruments GmbH, model OCA15).

The above prepared fuser belts had the following Table 1 characteristics.

TABLE 1

| | Young's Modulus (MPa) | CTE (ppm/° K) | Onset Decomposition T (° C.) |
|---|---|---|---|
| A commercial polyimide belt substrate | 6,000 | 15 | 510 |
| The disclosed polyimide/FLUOROLINK ® F10 = 99.95/0.05 belt substrate | 6,800 | 14.2 | 622 |

The surface energy of the disclosed fuser belt substrate was also measured and the results are shown in Table 2.

TABLE 2

| | Water Contact Angle (°) | Hexadecane Contact Angle (°) |
|---|---|---|
| A commercial polyimide belt substrate | 75 | 4 |
| The disclosed polyimide/FLUOROLINK ® F10 = 99.95/0.05 belt substrate | 75 | 4 |

The disclosed polyimide/perfluoropolyether fuser belt substrate possessed a higher modulus, a comparable CTE, and a higher decomposition temperature than the commercial polyimide fuser belt substrate. Thus, the mechanical properties and thermal stability of the disclosed containing polyimide/perfluoropolyether fuser belt substrate are improved versus the commercial polyimide fuser belt substrate.

The surface properties, such as surface energy of the disclosed polyimide/perfluoropolyether fuser belt substrate as measured by contact angles, were comparable to the commercial polyimide fuser belt substrate.

The above prepared fuser member polyimide/perfluoropolyether composition, and those disclosed herein can be selected as a fuser device or fuser belt in a xerographic imagining process, or the composition can be coated on a supporting substrate such as a polymer or other suitable known substrate.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A fuser member, suitable for use with a xerographic image forming system, comprising a substrate layer consisting of a mixture of a polyimide and a perfluoropolyether phosphate, optional fillers selected from the group consisting of aluminum nitride, boron nitride, aluminum oxide, graphite, graphene, copper flake, nano diamond, carbon black, carbon nanotube, metal oxides, doped metal oxide, metal flake, and mixtures thereof, and an optional polysiloxane polymer and an optional intermediate layer disposed on the substrate layer.

2. The fuser member in accordance with claim 1 wherein said perfluoropolyether phosphate is present in an amount of from about 0.01 to about 1 weight percent of the solids.

3. The fuser member in accordance with claim 1 wherein said perfluoropolyether phosphate is present in an amount of from about 0.03 to about 0.05 weight percent of the solids.

4. The fuser member in accordance with claim 1 wherein said perfluoropolyether phosphate is represented by the following formulas/structures

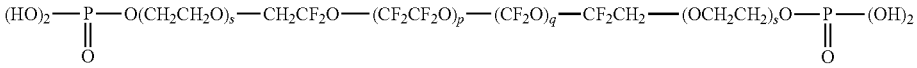

where the ratio of p/q is from about 0.5 to about 3, and s is 1 or 2.

5. The fuser member in accordance with claim 4 wherein said perfluoropolyether phosphate is present in an amount of from about 0.01 to about 0.5 weight percent of the solids.

6. The fuser member in accordance with claim 1 wherein said polyimide is represented by at least one of the following formulas/structures

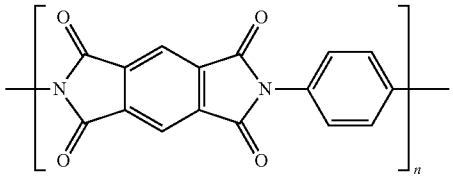

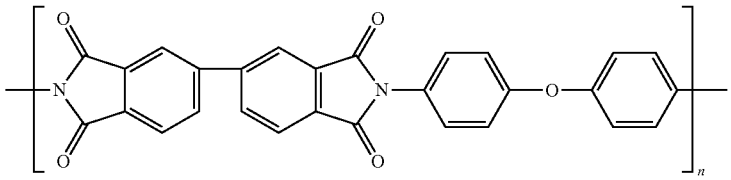

and

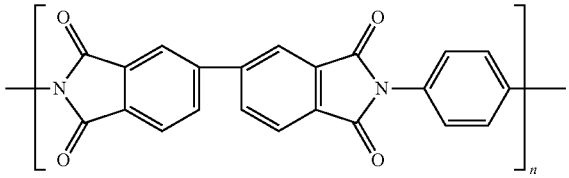

wherein n represents the number of repeating groups, and where said fuser member affixes a toner developed latent image present on a supporting substrate.

7. The fuser member in accordance with claim 1 wherein the substrate layer includes the polysiloxane polymer wherein said polysiloxane polymer is selected from the group consisting of a polyester modified polydimethylsiloxane, a polyether modified polydimethylsiloxane, a polyacrylate modified polydimethylsiloxane, and a polyester polyether modified polydimethylsiloxane.

8. The fuser member in accordance with claim 1 wherein the polyimide polymer and the perfluoropolyether phosphate are present in a weight ratio of about 99.99/0.01 to about 99.5/0.5.

9. The fuser member in accordance with claim 1 with a Young's modulus of from about 6,000 to about 10,000 MPa.

10. The fuser member in accordance with claim 1 wherein said fillers are present.

11. The fuser in accordance with claim 1 wherein said intermediate layer is present and a release layer is disposed on the intermediate layer.

12. The fuser member in accordance with claim 11 wherein the intermediate layer comprises silicone rubber.

13. The fuser member in accordance with claim 11 wherein the release layer comprises a fluoropolymer.

* * * * *